US006512665B1

(12) United States Patent
Maeder et al.

(10) Patent No.: US 6,512,665 B1
(45) Date of Patent: Jan. 28, 2003

(54) METHOD FOR SEPARATING A PLURALITY OF FLAT OBJECTS ARRANGED AT LEAST PARTIALLY ON TOP OF EACH OTHER, AT A PREDETERMINED POINT

(75) Inventors: Carl Conrad Maeder, Hinwil (CH); Markus Scheuber, Weisslingen (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/402,952

(22) PCT Filed: Apr. 7, 1998

(86) PCT No.: PCT/CH98/00129

§ 371 (c)(1),
(2), (4) Date: Oct. 13, 1999

(87) PCT Pub. No.: WO98/46508

PCT Pub. Date: Oct. 22, 1998

(51) Int. Cl.[7] ..... H05F 3/00
(52) U.S. Cl. ..... 361/214; 361/212; 361/220
(58) Field of Search ..... 361/220, 212, 361/214

(56) References Cited

U.S. PATENT DOCUMENTS 4,342,043 A * 7/1982 Palermiti et al. ..... 271/18

FOREIGN PATENT DOCUMENTS

| | | |
|---|---|---|
| CH | 440 339 | 12/1967 |
| CH | 534 588 | 3/1973 |

* cited by examiner

*Primary Examiner*—Stephen W. Jackson
(74) *Attorney, Agent, or Firm*—Rankin, Hill, Porter & Clark LLP

(57) ABSTRACT

A static charge is produced on surfaces of superimposed, flat articles (2) by passing the superimposed articles (2) through an electric d.c. voltage field that is oriented substantially perpendicular to the principal surfaces of the articles. Due to the charging, electric forces of attraction between the surfaces of the articles increase the mutual adhesion of the flat articles. The effect of the static charging is reduced or prevented for at least one of two surfaces participating at a predetermined separation point, by treating the surface beforehand with an anti-static agent (3). Due to the anti-static agent there is little or no charge concentration on the surface such that there is little or no increase in adhesion at the separation point. Thus, at the separation point it is possible to displace the articles against one another with much smaller force expenditure than is required to displace the articles at non-separation points. The method is particularly suitable for opening multipage printed products between two predetermined pages.

13 Claims, 3 Drawing Sheets

METHOD FOR SEPARATING A PLURALITY OF FLAT OBJECTS ARRANGED AT LEAST PARTIALLY ON TOP OF EACH OTHER, AT A PREDETERMINED POINT

BACKGROUND OF THE INVENTION

The invention relates to a method for separating a plurality of at least partly superimposed, flat articles at a predetermined point. The flat articles are, for example, made from paper, cardboard, fabric, felt or plastic. The plurality of flat articles to be separated may be, for example, a multipage printed product made from paper, plastic or cardboard, which is to be opened at a predetermined point. The articles may also be a stack or scale formation of printed products or of flat articles made from cardboard, fabric, felt or plastic and from which stack or scale formation a specific number of articles are to be removed by separation of the plurality at a predetermined point.

Superimposed, flat articles are frequently separated from one another by inserting a separating element, e.g. a separating wedge between the articles to be separated. The more congruent, thin and sensitive to mechanical damage the articles in question are, the more difficult it is to successfully effect separation using a separating element. On the one hand, it is difficult to aim the element precisely at a predetermined point and, on the other hand, the risk of the separating element damaging the narrow sides or edges of the flat articles is not negligible.

Therefore, superimposed, flat articles are advantageously displaced against one another parallel to their principal surfaces, prior to an effective separation. By such displacement, areas of the principal surfaces of individual articles are exposed. These principal surface areas are much better suited to being acted upon by a mechanical separating element than the narrow side areas of the articles.

CH-440339 describes a method for displacing, relative to each other, two directly superimposed articles within a plurality of superimposed articles. The CH '339 method employs a displacement force having a component parallel to the principal surfaces of the articles. In this method, there is no action on individual narrow sides or edges of the articles. To enable desired displacement between two specific articles of the plurality of superimposed articles (predetermined separation point), while the other articles remain substantially undisplaced with respect to one another, the adhesion between the two specific articles is reduced, compared to the adhesion between the other articles, by measures suitable for reducing the friction coefficient between the two specific articles.

Measures for reducing the friction coefficient include treating at least one of the surfaces of the articles to be displaced with a lubricant or smoothing the surface or positioning a sliding film between the articles to be displaced. Examples of lubricants are waxes, high-viscosity silicone oils or dry lubricants.

Building upon the teaching of the aforementioned patent, CH-534588 describes how a stack of flexible sheets is made separable at a plurality of different, predetermined points, by applying friction coefficient reducing measures to different, predetermined sheets in non-overlapping areas. The stack is separated at a specific one of the predetermined separation points by directing the displacement force to the associated or corresponding treated area.

It has been found that the processes according to CH-440339 and CH-534588 give satisfactory results in many applications. However, it has also been found that in other cases the reliability with which the displacement is effected exactly at the predetermined point is inadequate. Accordingly, the prior art methods cannot be used when high accuracy is required. Such cases include the separation of pages of multipage printed products for the purpose of opening the product at a predetermined point. This is especially so when the individual pages of the printed products are made from a very smooth or correspondingly coated material and therefore adhere very little to one another, and/or when the individual pages of the printed products are made from different materials with different friction characteristics.

SUMMARY OF THE INVENTION

An object of the invention is to provide a method for separating a plurality of at least partly superimposed, flat articles at a predetermined point. With the aid of the method according to the invention it is to be possible to solve separating problems in applications wherein known methods are unusable, and/or to attain better results than possible with the known methods.

The method according to the present invention utilizes the fact that the adhesion between superimposed, flat articles can be increased by static charging of their surfaces. According to the inventive method, a static charge is produced on the surfaces of the superimposed, flat articles by passing the articles through an electric d.c. voltage field oriented substantially perpendicular to the principal surfaces of the articles. Due to the effect of the field, dipoles are oriented or charges are displaced perpendicular to the principal surfaces and positive or negative charges are concentrated on the two surfaces of each of the articles. These charges cause electric attraction forces between the surfaces of superimposed articles and, therefore, increase the mutual adhesion.

The effect of static charging of surfaces of superimposed, flat articles is reduced or prevented for at least one of two surfaces disposed at a predetermined separation point, by treating the surface beforehand with an anti-static agent. Due to the limited conductivity of the anti-static agent, charges cannot concentrate on the treated surface or they are very rapidly compensated. Thus, passage through the voltage field causes minimal or zero adhesion increase at the separation point, and causes much less adhesion increase at the separation point than at the non-treated surfaces. Therefore, the treated surfaces can be displaced or moved relative to each other with a lower force than is necessary to displace non-treated surfaces. Accordingly, low force displacement distinguishes the separation point or treated surfaces from the non-treated surfaces.

Application of a static charge for increasing the adhesion between flat articles not to be separated combined with a planned application of anti-static agent for suppressing the static-charge adhesion effect at a separation point can also be combined with a reduction of the friction between the flat articles to be separated by applying a lubricant, as described hereinbefore as prior art. Since for such a combination both the anti-static agent and the lubricant are advantageously used on the same surface areas, the two agents can be applied and used simultaneously in the form of a mixture in a single method step. It is also possible to add a luminophore to the anti-static agent or to the mixture of anti-static agent and lubricant. The luminophore is useful for checking the separation at the predetermined separation point with the aid of luminescence sensors.

BRIEF DESCRIPTION OF THE DRAWINGS

The method according to the invention is described in greater detail hereinafter with reference to the attached drawings, wherein.

DETAILED DESCRIPTION OF THE PREFERRED EMBODIMENTS

Figure 1:
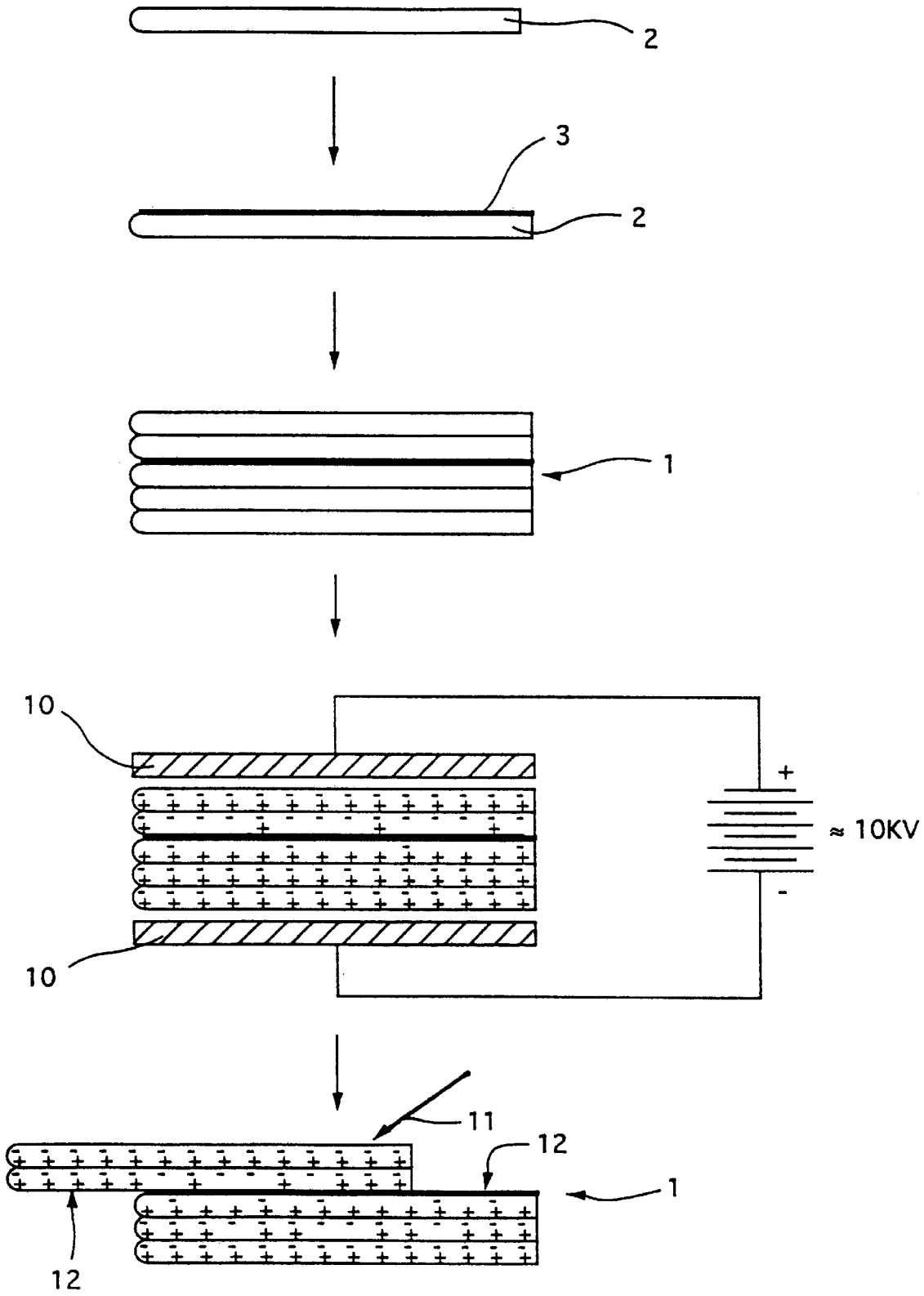
FIG. 1 shows a diagram of the successive steps of the inventive method.

FIG. 1 shows a diagram of the successive method steps using the example of a stack 1 comprising five superimposed, flat articles 2. The stack is to be separated by displacing the two upper articles with respect to the three lower articles. Thus, the predetermined separation point is located between the upper surface of the third article and the lower surface of the fourth article within stack 1.

Before or during stacking articles 2, at least one of the surfaces participating at the separation point is treated, preferably by being coated with an anti-static agent 3.

Anti-static agents are more particularly known from the plastics industry. They are, for example, conductive particles (e.g. carbon black, carbon fibers, nickel-coated mica, steel fibers or aluminum platelets) finely distributed usually in a plastic matrix, or ionic compounds (e.g. quaternary ammonium salts), surfactants (e.g. glycol esters, glycol ethers or esters and salts of fatty acids) or hygroscopic substances (e.g. glycerol or polyglycol), which are used as such or in the form of aqueous or alcoholic solutions.

Treatment of the desired surface(s) with the anti-static agent may comprise spraying or roller application if the agent is liquid or melted. In the case of a solid agent, treatment may comprise direct rubbing-off or rubbing-off with a brush onto the surface to be treated. For applications of the inventive method to printed paper, it is also possible to mix the aforementioned conductive particles into the printing ink with which the paper is printed. For this purpose, the conductive pigment Minatec® sold by Merck in Darmstadt is suitable.

Through the application of such anti-static agents the surface resistance of the treated surfaces is reduced to normally $10^{10}$ to $10^{8}\Omega$.

The surface treated with the anti-static agent 3 constitutes within the stack one of the surfaces to be displaced relative to each other. It is obviously also possible and even advantageous in certain applications to treat both surfaces participating at the separation point.

After treatment, the stack 1 is then exposed to a d.c. voltage field, wherein the field lines are oriented substantially perpendicular to the principal surfaces of the articles. For this purpose the stack is passed between two electrodes 10, e.g. between two plates or rods to each of which a different constant potential is applied. By the effect of the field, dipoles are oriented or charges are displaced within the flat articles. Between the two surfaces of an article a potential difference is built up, or the surfaces of the article are statically charged (diagrammatically represented by small plus and minus signs in FIG. 1). These charges are opposed at superimposed surfaces of adjacent articles and cause electric forces of attraction between the articles.

At surface points where the anti-static agent acts, little or no charge can build up as a result of the increased surface conductivity, so that in such surface areas the forces of attraction between the adjacent articles are correspondingly lower.

In the method diagrammatically illustrated by FIG. 1, the entire surface of an article 2 is treated with the anti-static agent and the entire stack or the entire base surface of the stack is exposed to the d.c. voltage field. However, it is considered apparent that these are not required conditions for practicing the method according to the present invention. As will be shown in connection with FIGS. 3 and 4, the anti-static agent may be applied to a surface only zonally. It is also possible to electrostatically charge only part of the stack. However, electrostatic charging is to coincide with treated surface areas wherein the charged area may be smaller than the treated area.

Apparatuses for producing static charges on flat articles are known in the paper-processing industry. They are, for example, used to prevent mutual displacement of loosely superimposed paper webs or sheets. An example of such an apparatus is the ion shooter of Spengler Electronics AG, Biel-Benken (Switzerland).

The voltage difference between the two electrodes 10 of such an apparatus is approximately 10 kV.

Immediately after static charging, a displacement force (arrow 11) is applied to the stack 1. The displacement force 11 acts on the stack surface and has a component parallel to the principal surfaces of the articles. By this displacement force 11, the two surfaces in the stack adhering least to one another are displaced relative to one another. Displacement of these two surfaces occurs even if the force does not act at the separation point but acts on the stack surface.

By displacing two articles of the stack relative to or against one another, areas 12 of principal surfaces of these articles are exposed and can thereafter be acted on with mechanical means in order to effectively separate the articles of the stack. For such an action the risk of damaging the articles is much lower than for an action on narrow sides (edges) of articles as is necessary for a separation without prior displacement. In addition, the exposed principal surfaces define the separation point in such a way that it cannot be missed by a mechanical separating element.

Figure 2:
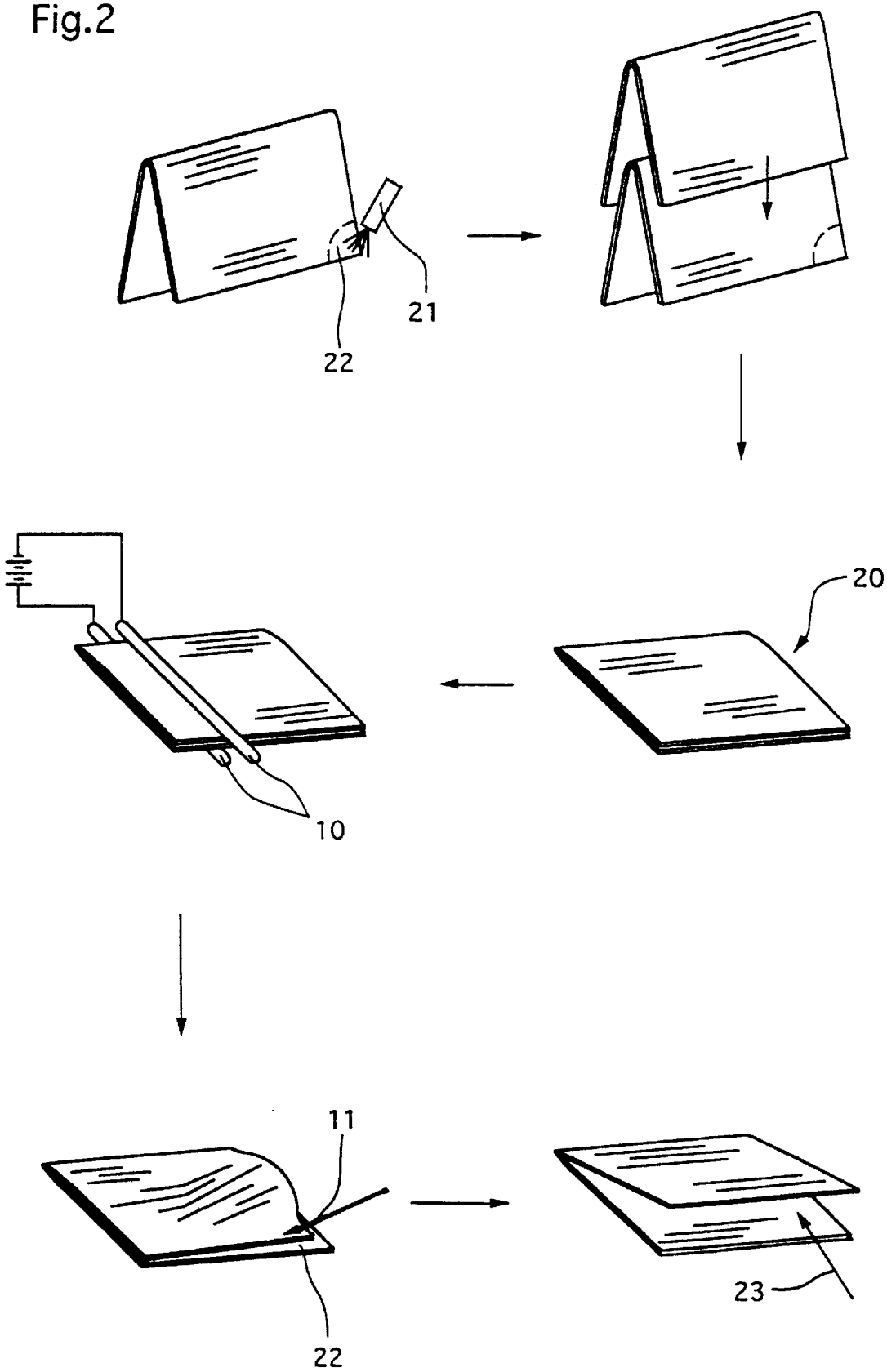
FIG. 2 shows the inventive method using the example of multipage printed products to be opened at a predetermined point.

FIG. 2 diagrammatically shows as an example of an application of the inventive method in the production of a multipage printed product 20, such as a magazine or brochure. FIG. 2 also illustrates opening of the printed product 20 between two predetermined pages to facilitate insertion of a supplement.

The printed product is, for example, grouped and stitched in a collecting and stitching drum through collecting prefolded sheets, as is very diagrammatically shown in the top line of FIG. 2. Additionally, the printed product can also be trimmed on three sides. During such collecting, a corner area 22 is treated with an anti-static agent, preferably by spraying from a spray head 21 onto an inner page of the printed product.

Following production, the closed printed product is passed between two electrodes 10, so that the pages of the product are statically charged. Immediately following charging, a displacing force 11 is applied to the outside of the printed product in the corner area in which one of the inner pages was treated with the anti-static agent. Due to the force, the pages between the separation point and the force application are deformed and displaced relative to the other pages. It is now possible without any risk to insert into the printed product a per se known opening element (not shown) at the separation point and to insert a supplement (arrow 23).

Figure 3:
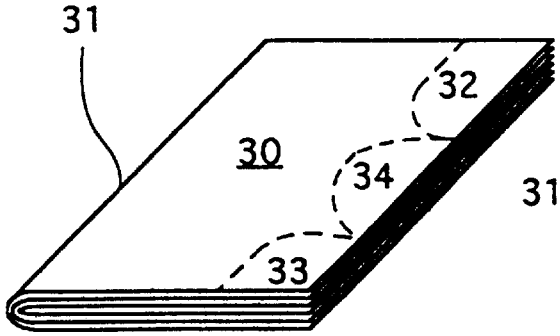
FIGS. 3 and 4 show two examples of printed products provided with a plurality of predetermined opening points.
Figure 4:
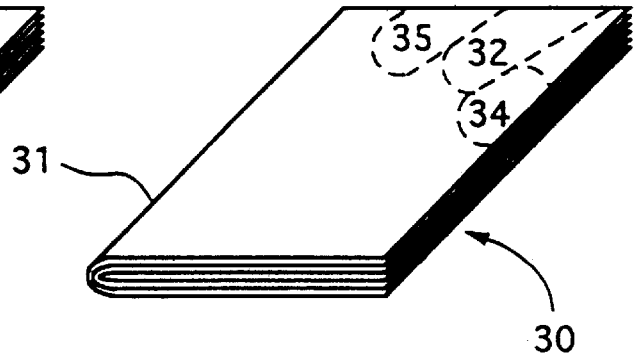

FIGS. 3 and 4 show a multipage printed product 30 with a bound, stitched or glued spine 31. The printed product has more than one predetermined separation point. In the same way as described hereinbefore, the separation points are implemented by pages, which zonally carry an anti-static agent. The treated areas of the different separation points are advantageously non-overlapping corner areas 32, 33 and/or edge-adjacent areas 34, 35. After statically-charging the articles, it is possible to open the product to a specific one of the separation points by applying a displacement force on the outside of the product in one of the areas 32–35.

The static charge on flat articles produced by the d.c. voltage field dissipates in a relatively short time. Therefore, it is important to provide the displacement force immediately after charging. However, the action of the anti-static agent remains over a very long time, so that the time between the application of the agent and the charging can be of any length. At any time after a first charging, charging can be repeated and the articles can be again mutually displaced in the described manner and at the same predetermined separation point.

What is claimed is:

1. A method for separating a plurality of at least partly superimposed flat articles at a predetermined separation location between two adjacent surfaces of a pair of adjacent articles, comprising the steps of:

applying an antistatic agent to at least part of at least one of said two adjacent surfaces and thereby defining said predetermined separation location;

exposing the plurality of flat articles to an electric field and thereby increasing adhesion by static charging between adjacent surfaces of ones of the articles not to be separated;

applying a separation force to said plurality of articles, said separation force having a component parallel to a flat expanse of the articles, and thereby separating the plurality of articles at the predetermined separation location.

2. The method according to claim 1, wherein said at least one surface is simultaneously treated with the anti-static agent, and with a lubricant and/or luminophore.

3. The method according to claim 1, wherein the anti-static agent is liquid and is sprayed onto said at least one surface.

4. The method according to claim 3, wherein the anti-static agent includes substances selected from the group consisting of electrically conductive particles, an ionic compound, a surfactant and a hygroscopic substance, and wherein said at least one surface treated with the anti-static agent has a surface resistance of $10^{10}$ to $10^{8}\Omega$.

5. The method according to claim 1, wherein the flat articles are made of printed paper and the anti-static agent comprises conductive particles that are admixed with the printing ink and applied to the surface to be treated during printing.

6. The method according to claim 1, wherein the electric field is a d.c. voltage field, said d.c. voltage field having a potential difference of about 10 kV.

7. The method according to claim 1, wherein the plurality of articles define a stack and wherein the stack is exposed to the electric field, said electric field being a d.c. voltage field.

8. The method according to claim 1, wherein the articles are only zonally exposed to the electric field, the areas exposed to said electric field substantially coinciding with an area treated with the anti-static agent of said least one surface.

9. The method according to claim 1, wherein, for separating a plurality of superimposed, flat articles at a plurality of predetermined separation points, a plurality of surfaces are treated in non-superimposed and non-overlapping areas with an anti-static agent and the displacement force for separating a specific one of the plurality of separation points is directed to the treated area of one of the surfaces participating at the specific separation point.

10. A use of the method according to claim 1, wherein said method is used for predetermined opening of multi-page printed products.

11. The use according to claim 10, wherein, during production, a plurality of pages of the multi-page printed products are treated with the anti-static agent at an area selected from the group consisting of non-overlapping corner areas and edge-bordering areas.

12. The use according to claim 10, wherein, together with the anti-static agent, a luminophore is applied and the predetermined opening is checked with a luminescence sensor.

13. The method according to claim 1, wherein the anti-static agent is solid and is rubbed onto said at least one surface.

* * * * *

UNITED STATES PATENT AND TRADEMARK OFFICE

CERTIFICATE OF CORRECTION

PATENT NO. : 6,512,665 B1
DATED : January 28, 2003
INVENTOR(S) : Maeder et al.

It is certified that error appears in the above-identified patent and that said Letters Patent is hereby corrected as shown below:

Title page, Item [54] and Column 1, lines 1-4,
Delete the title and replace with -- METHOD FOR THE SEPARATION OF A PLURALITY OF AT LEAST PARTLY SUPERIMPOSED, FLAT ARTICLES AT A PREDETERMINED POINT --.

Title page,
Add -- Foreign Application Priority Data,
April 16, 1997 (CH)……. 0889/97 --.

Signed and Sealed this

Third Day of June, 2003

JAMES E. ROGAN
*Director of the United States Patent and Trademark Office*